US007261578B2

(12) United States Patent
Zhao

(10) Patent No.: US 7,261,578 B2
(45) Date of Patent: Aug. 28, 2007

(54) CARD CONNECTOR

(75) Inventor: Sen-Bing Zhao, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/407,159

(22) Filed: Apr. 19, 2006

(65) Prior Publication Data

US 2006/0234539 A1 Oct. 19, 2006

(30) Foreign Application Priority Data

Apr. 19, 2005 (CN) ..... 2005 2 0070986

(51) Int. Cl.
*H01R 29/00* (2006.01)

(52) U.S. Cl. ..... 439/188; 439/159; 439/630

(58) Field of Classification Search ..... 439/188, 439/159, 630; 200/51.1; 235/441
See application file for complete search history.

(56) References Cited

U.S. PATENT DOCUMENTS 6,382,993 B1 * 5/2002 Chen ..... 439/157
6,382,994 B1 * 5/2002 Chang ..... 439/157
6,390,836 B1 * 5/2002 Motegi et al. ..... 439/159
6,488,528 B2 * 12/2002 Nishioka ..... 439/489
6,520,783 B2 * 2/2003 Hsu ..... 439/157
6,692,277 B2 * 2/2004 Hu et al. ..... 439/188
6,709,281 B2 3/2004 Shishikura et al.
6,764,327 B2 * 7/2004 Yu ..... 439/188
7,101,207 B1 * 9/2006 Chi-Te ..... 439/188

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

A card connector includes an insulating housing (4) defining a receiving space (44) and a receiving cavity (421) communicating with the receiving space (44); a plurality of contacts (2); an ejector (5) comprising an insulating slider (51) sliding in the receiving cavity (421) and an ejecting member (53) protruding into the receiving space (44); and a switch (3) comprising a pair of conductive pieces and a conductive plate (561), said conductive plate (561) being fixed to said slider (51), said conductive pieces engaging with said slider (51); wherein both of said pair of conductive pieces coming into contact with said conductive plate (561) when the card (6) urges the slider (51) sliding to a first position, while at least one of the conductive piece coming out of contact with said conductive plate (561) when the ejector (3) ejects the card and urges the slider (51) sliding to a second position.

19 Claims, 7 Drawing Sheets

CARD CONNECTOR

BACKGROUND OF THE INVENTION

1. Field of the Invention

The present invention is generally related to a card connector, and especially to a card connector with switch for detecting a position of an electronic card.

2. Description of Related Art

Integrated circuit (IC) cards are connected to other electronic devices electrically in conjunction with corresponding card connectors. In order to contact or cut electrically between IC cards and other equipments accurately and conveniently, the card connectors commonly equip with switches to achieve above-mentioned object.

U.S. Pat. No. 6,709,281 discloses a commonly card connector for receiving an electrical card. The card connector defines a card receiving space and comprises an insulating housing, a plurality of contacts exposed into the card receiving space and arranged on a bottom wall of the insulating housing and a write protect switch. The write protect switch comprise a first piece of metal made from a stationary piece of metal; and a cantilevered second piece of metal having a projecting touching portion, the projecting touching portion can come in contact with the electrical card. With the electrical card sliding to one of two positions: a protect-on position (write inhibit position) and a protect-off position (write enable position), the two metal pieces can be connected or separated structurally and electrically.

In normal state, the write protect switch can detect a slide position of a electrical card. However, because the first piece meets the second piece simply to connect each other, dust and other matter residing on both of communication portions thereof can not be cleared automatically so as to the connecting performance is not reliable.

Hence, an improved card connector is highly desired to overcome the aforementioned disadvantages of the prior art.

SUMMARY OF THE INVENTION

Accordingly, an object of the present invention is to provide a card connector which has a switch for detecting a slide position of a card conveniently and reliably.

To achieve the above-mentioned object, a card connector adapted for receiving a card comprising: an insulating housing defining a card receiving space for accommodating a card and a receiving cavity communicating with the card receiving space; a plurality of contacts retained in the insulating housing; an ejector assembled to the insulating housing and comprising an insulating slider sliding in the receiving cavity and an ejecting member protruding into the card receiving space; and a switch comprising a pair of conductive pieces and a conductive plate, said conductive plate being fixed to said slider, said conductive pieces retained in said insulating housing and engaging with said slider; wherein both of said pair of conductive pieces come into contact with said conductive plate when the card inserts and urges the slider sliding to a first position, while at least one of the conductive piece comes out of contact with said conductive plate when the ejector ejects the card and urges the slider sliding to a second position.

Other objects, advantages and novel features of the present invention will be drawn from the following detailed description of a preferred embodiment of the present invention with attached drawings.

DETAILED DESCRIPTION OF THE INVENTION

Figure 1:
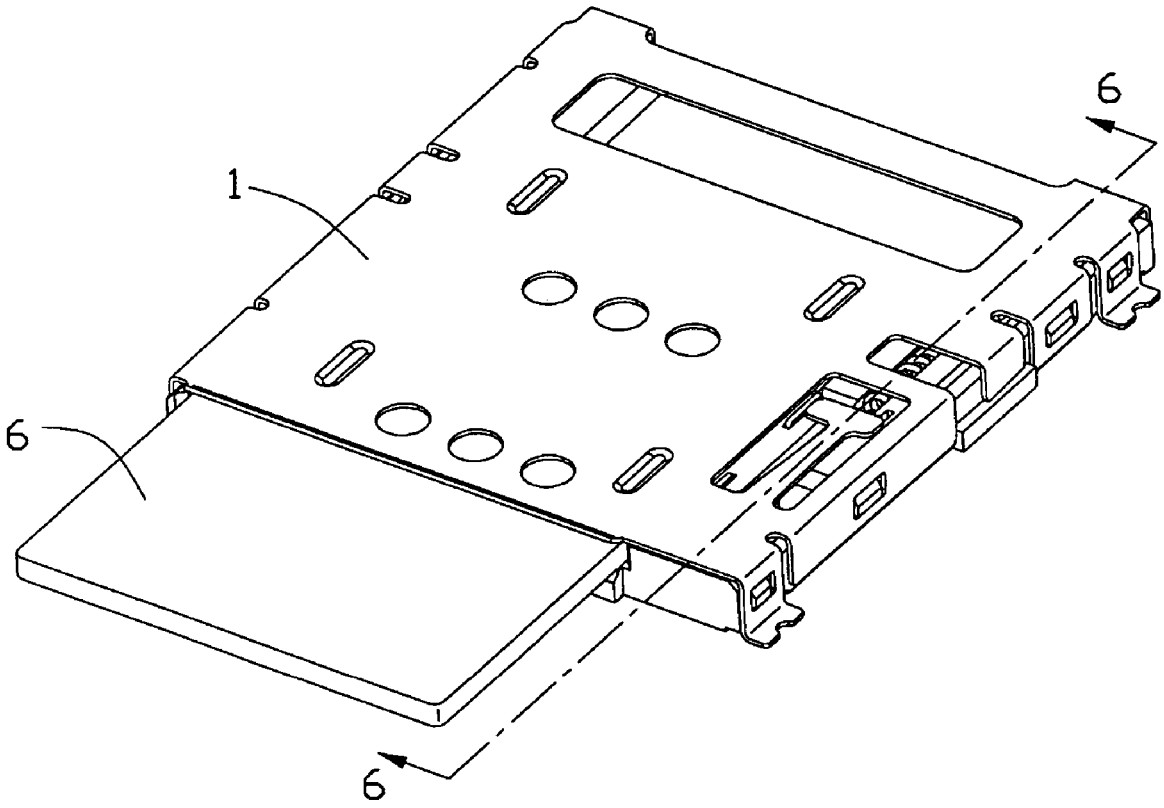
FIG. 1 is an assembled, perspective view of a card connector in accordance with the present invention with a card accommodated therein.

Reference will now be made in detail to the preferred embodiment of the present invention.

Referring to FIGS. 1-7, the card connector in accordance with the present invention is adapted for receiving a card 6, such as a SIM card. The card connector comprises an insulating housing 4, a plurality of contacts 2 received in the insulating housing 4, a switch 3, a ejector 5 and a shell 1 for covering the insulating housing 4.

Figure 2:
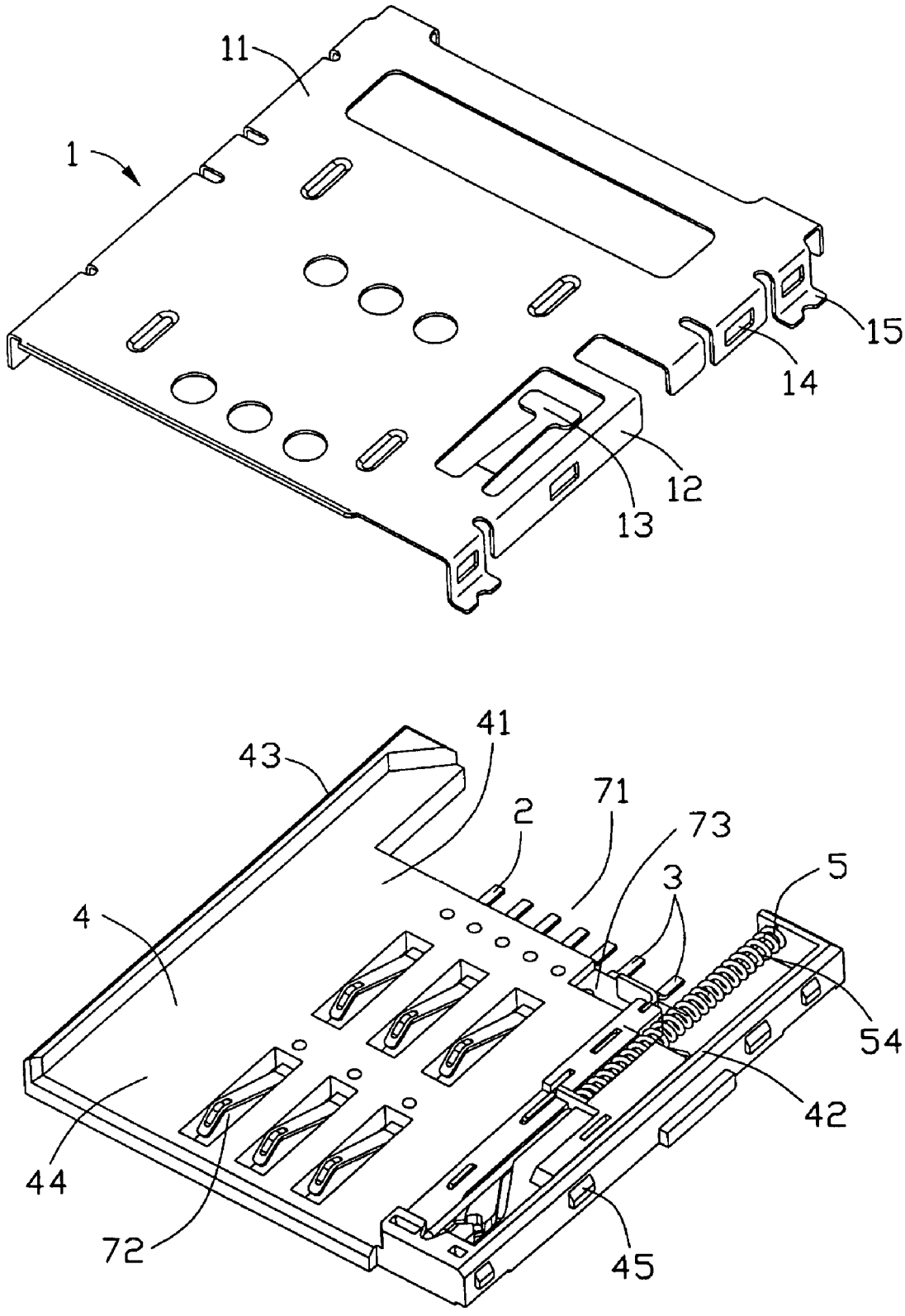
FIG. 2 is an exploded, perspective view of the card connector of FIG. 1 with an ejector assembled to an insulating housing.

Referring to FIG. 2, the insulating housing 4 is approximately frame configuration. The insulating housing 4 comprises a bottom wall 41 and a pair of opposite right and left sidewalls 42,43 extending upwardly from lateral sides of the bottom wall 41, all of which commonly define a card receiving space 44 for accommodating the SIM card 6. The bottom wall 41 defines an opening 71 at rear end thereof and is formed with a plurality of rectangular receiving passages 72 arranged in two rows along a card insertion/ejection direction. The right and left sidewalls 43,42 are formed with a plurality of wedges 45 on outsides thereof, respectively.

Figure 4:
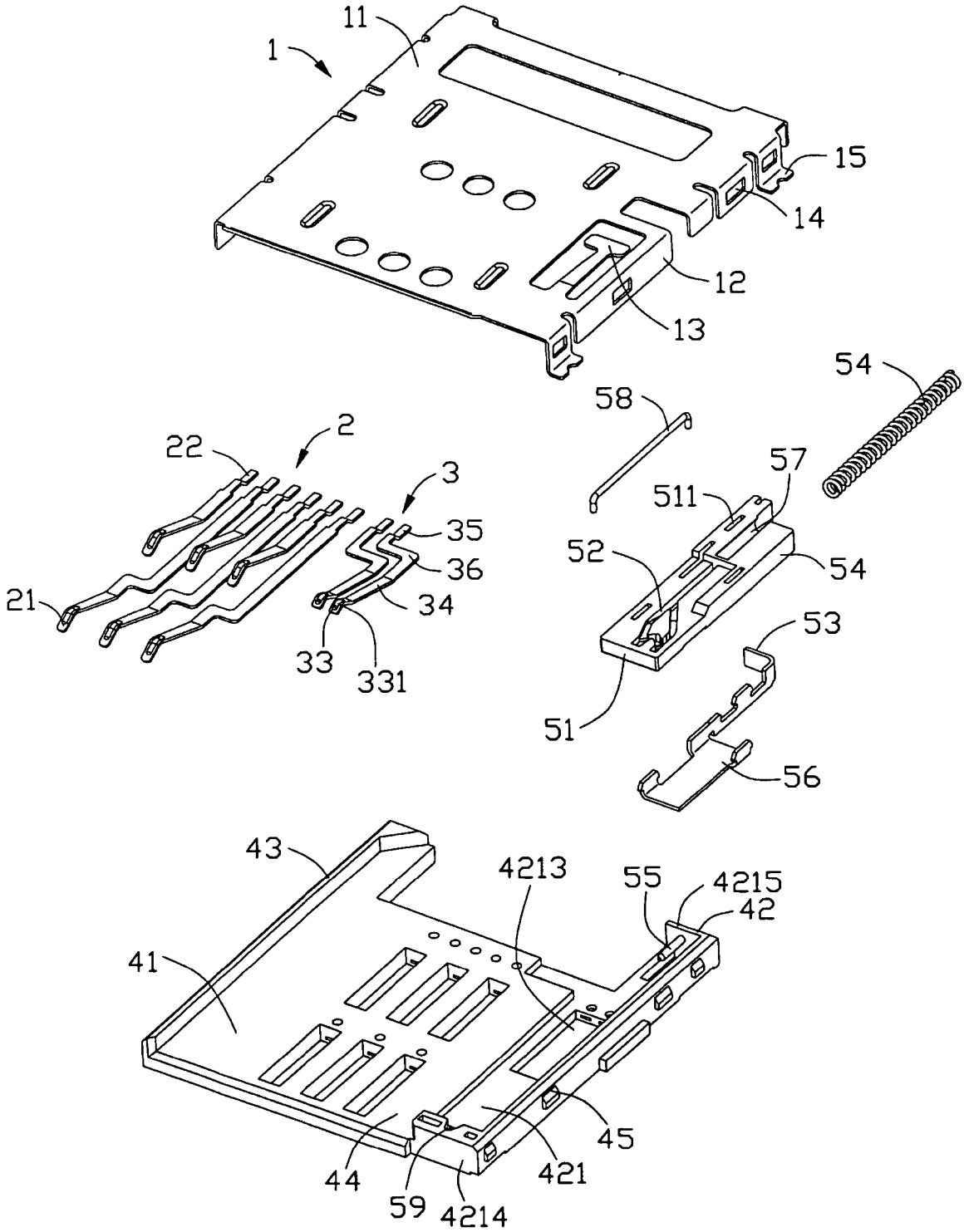
FIG. 4 is an exploded, perspective view of the card connector of FIG. 1.
Figure 5:
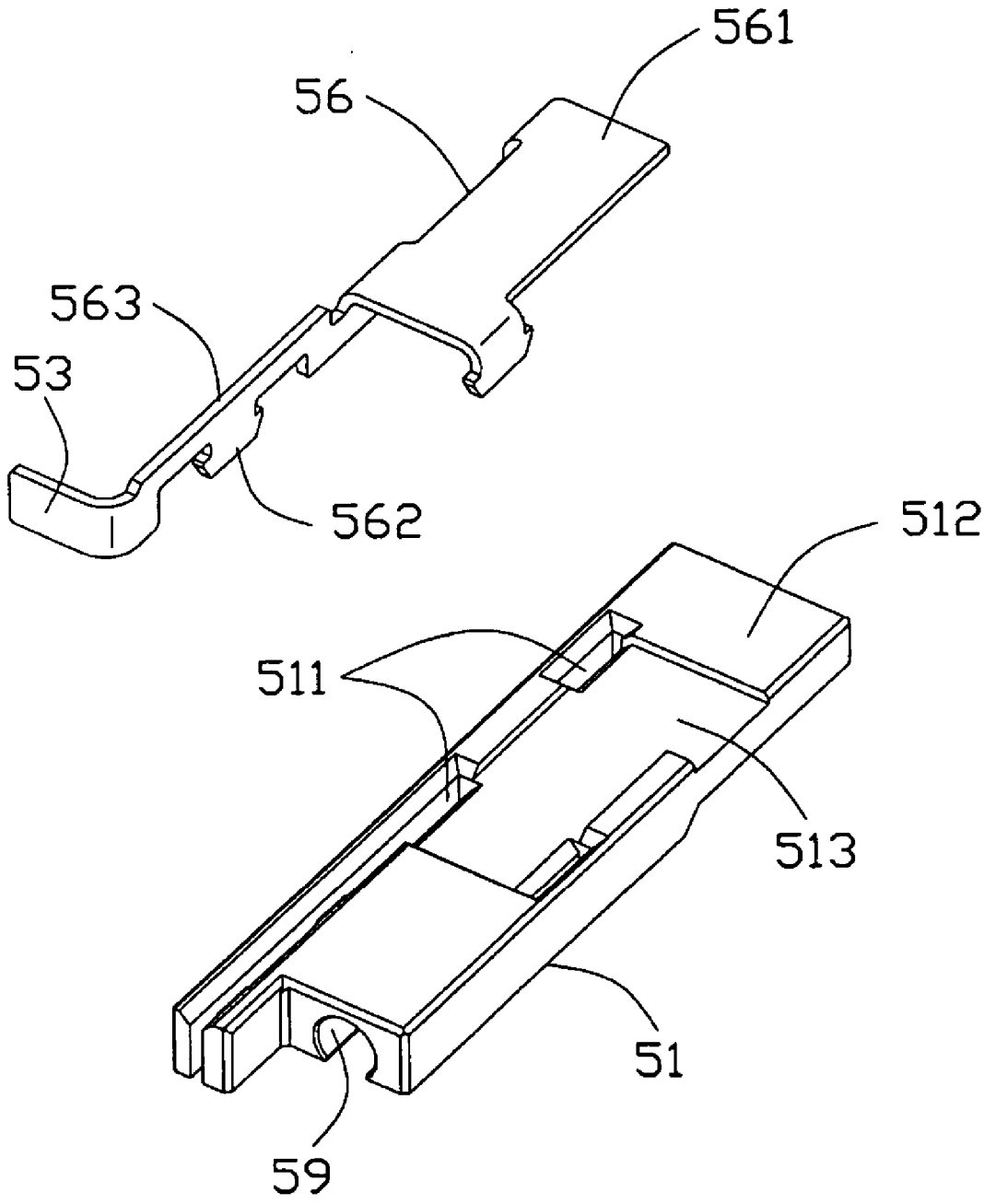
FIG. 5 is an exploded, perspective view of the ejector and the horizontal plate of the card connector of FIG. 1.

Referring to FIG. 2 and FIG. 4, the contacts 2 are divided into two groups which are retained in the insulating housing 4, respectively. Each contact 2 comprises a contacting portion 21 received in the corresponding receiving passage 72 and partially exposed into the card receiving space 44, an intermediate portion (not labeled) extending rearward from the contacting portion 21 and retained in the insulating housing 4, and a soldering portion 22 soldered joint to a contact pad or the like on a printed circuit board (not shown). The soldering portion 22 extends rearward from the intermediate portion to expose into the opening 71.

As shown in FIG. 4, the left sidewall 42 of the insulating housing 4 is formed with a front wall 4214 and a rear wall 4215 at front and rear ends thereof, together with the bottom wall 41 defining a rectangular receiving cavity 421 communicating with the card receiving space 44. The bottom wall 41 defines a recess 73 at rear end thereof faced to the opening 71 to communicate with the receiving cavity 421. A column 55 protrudes forwardly from the rear wall 4215 and is exposed into the receiving cavity 421. The left sidewall 42 defines a rectangular recess section 4213 downwardly recessed from a bottom face of the receiving cavity 421 and locating approximately in middle of the receiving cavity 421.

Figure 3:
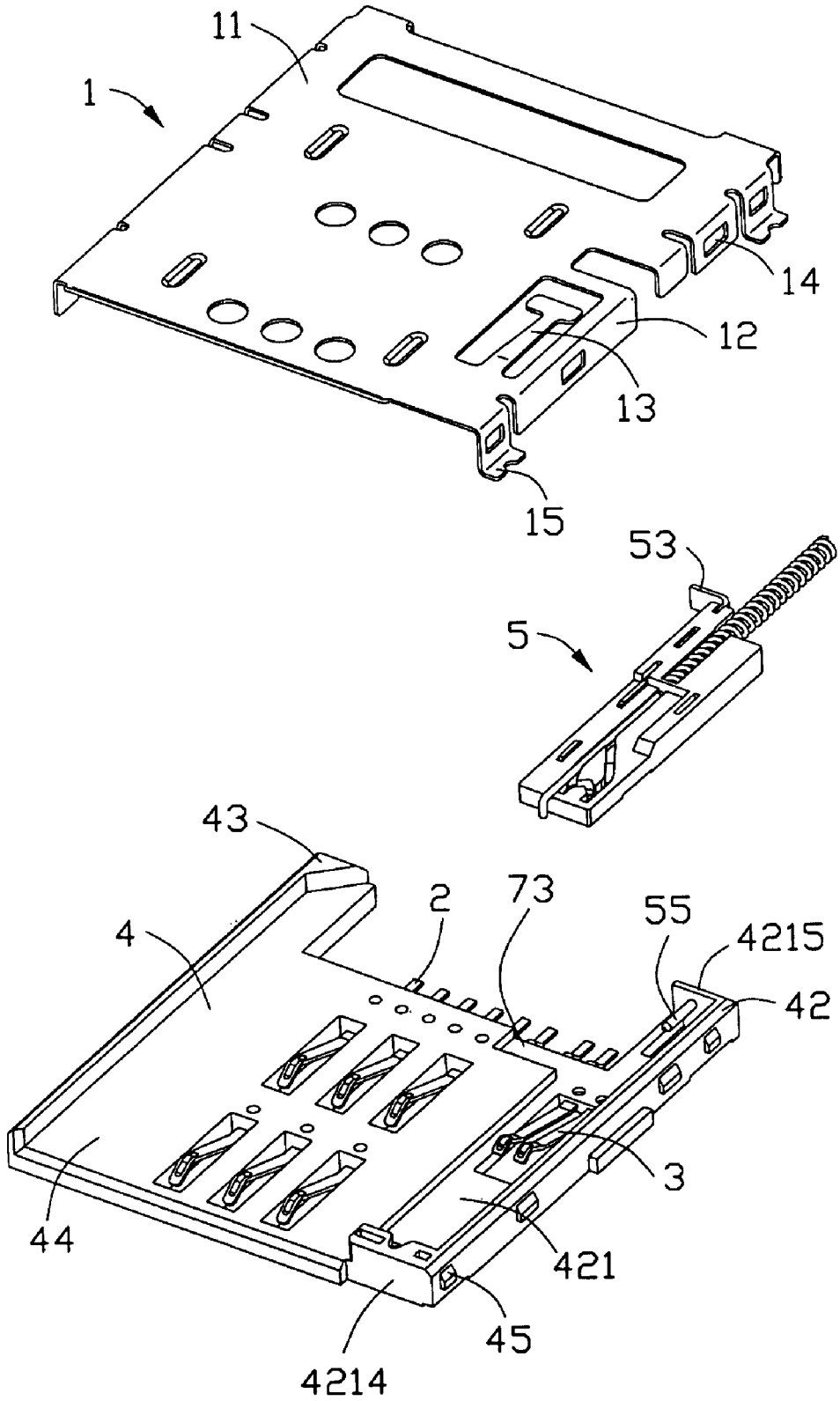
FIG. 3 is an exploded, perspective view of the card connector of FIG. 1 with an ejector detached from an insulating housing.

Referring to FIGS. 2 and 3, the ejector 5 is used for ejecting the SIM card 6 out of the card connector. The ejector 5 comprises a slider 51, a pin member 58 with two bent ends, a resilient member 54 and an ejecting member 53 for contacting and ejecting the SIM card 6 directly. In this embodiment, the resilient member 54 is a spring, and the ejecting member 53 is unitary with the slider 51 so that the ejecting member 53 can protrude into the card receiving space 44 to eject the SIM card 6.

The slider 51 is approximately an elongated cube configuration and is received in the receiving cavity 421 to move along the card insertion and ejection direction with the SIM card 6 inserted and ejected. The slider 51 defines a heart-shaped slot 52 recessed downwardly from a top face thereof, a semi-circular receiving hole 57 recessed forwardly from a rear face thereof and a plurality of through slots 511 recessed upwardly from lateral sides of a bottom face 512 to a top face of the slider 51. One end of the spring 54 is disposed around the column 55 of the rear wall 4215 and the other end is disposed into the receiving hole 57 of the slider 51. One end of the pin member 58 is moveably disposed in the heart-shaped slot 52 of the slider 51 and the other end is securely locked in a pinhole 59 of the front wall 4214 of insulating housing 4. The pin member 58 and the heart-shaped slot 52 are served as holding means and can hold the slider 51 in a write enable position where the card 6 is electrically connected with the card connector and can release the slider 51 when ejecting the card 6.

The ejecting member 53 and a metal portion 56 are integrally stamped from a metal sheet. The metal portion 56 comprises a horizontal conductive plate 561, and a holding arm 563 extending upward and rearward from rear end of one side of the horizontal conductive plate 561 adjacent to the card receiving space 44. The holding arm 563 joints the ejecting member 53 to the metal portion 56. A plurality of hooks 562 protrudes upwardly from the holding arm 563 and lateral sides of the horizontal conductive plate 561, respectively. In addition, the holding arm 563 is formed with the rectangular plate-shaped ejecting member 53 bent from a free end thereof and transversely protruding into the card receiving space 44 and locating above the recess 73 of the bottom wall 41. The ejecting member 53 is securely assembled to the slider 51 with the hooks 562 interferentially received in the through slots 511 of the slider 51. The slider 51 is provided with a cutout 513 recessed upwardly from the bottom face 512 thereof so that the horizontal conductive plate 561 is applied.

The switch 3 comprising the horizontal conductive plate 561 and a pair of cantilevered pieces retained in the insulating housing 4 in a row vertical the card insertion/ejection direction. Each piece has a scraping/contacting portion 33 received in the rectangular recess section 4213 and partially exposed into the receiving cavity 421, a cantilevered portion 34 extending rearward from the scraping/contacting portion 421, a stationary portion 36 extending sideward and rearward from the cantilevered portion 34 and retained in the insulating housing 4, and a tail portion 35 exposed into the opening 71 to align with the soldering portions 22 of the contacts 2. The scraping/contacting portion 33 has a contact portion 331 protruding in arc.

Referring to FIG. 1 and FIG. 2, the shell 1 is made of metal sheet to cover the housing 4. The shell 1 comprises a base portion 11 and a pair of opposite right and left side portions 12 extending downwardly from lateral sides of the base portion 11. Furthermore, the base portion 11 is formed with a resilient piece 13 at front end thereof adjacent to the left side portion 12 for pressing downwardly against the pin member 58 in the heart-shaped slot 52 of the slider 51 of the ejector 5. Each side portion 12 is formed with a plurality of mating holes 14 for receiving the wedges 45 of the insulating housing 4 and two pairs of soldering feet 15 on opposite distal ends along the card insertion and ejector direction for being mounted on the printed circuit board. Thus, the shell 1 is securely assembled to the insulating housing 4, and the card connector is securely assembled to the printed circuit board.

Figure 6:
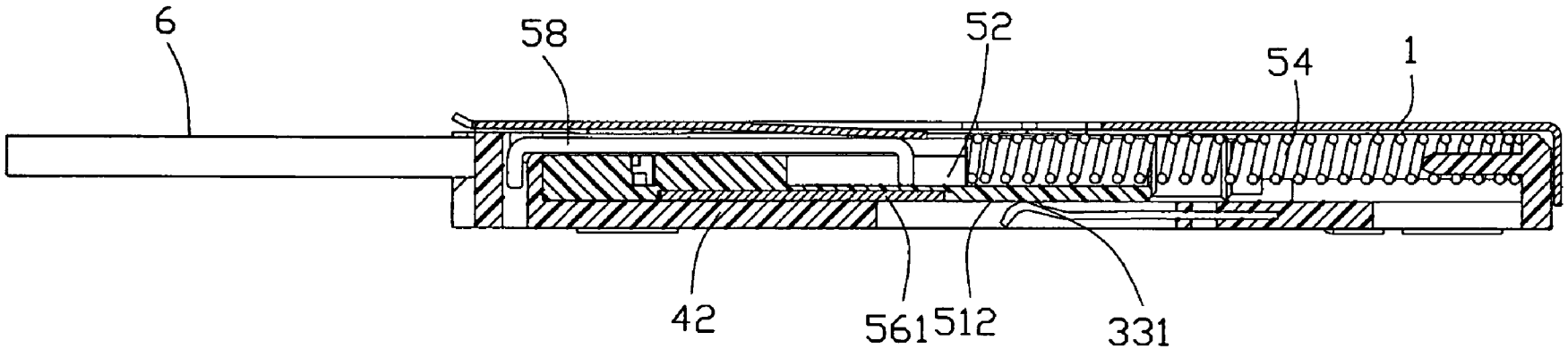
FIG. 6 is a cross-sectional view of FIG. 1 taken along line 6-6 with the card at the write inhibit position.

As shown in FIG. 2 and FIG. 6, the ejector 5 assembled to the insulting housing 4 is received in the receiving cavity 421 to slide along the card insertion/ejection direction. The two pieces of the switch 3 are pre-loaded on grounds of the weight of the ejector 5. The ejector 5 is positioned on a write inhibit position because of the resilient force of the spring 54, where the scraping/contacting portions 33 of the two pieces engage with the bottom face 512 of the slider 51.

In process of the SIM card 6 inserting the card connector, a rear end of a left side of the card 6 will enter into a cavity defined by the slider 51 and the ejecting member 53 of the ejector 5 to collide with the ejecting member 53. Then, to drive the slider 51 to move along the card insertion direction and to urge the spring 54 to elastically compress. In the meantime, the contact portions 331 of the scraping/contacting portions 33 of the two pieces of the switch 3 scrape and come in contact with the bottom face 512 of the slider 51, then the horizontal plate 561 of the metal portion 56. In addition, the pin member 58 moves along the heart-shaped slot 52 of the ejector 5 to make the slider 51 finally achieve a write enable position where the card 6 is electrically connected with the contacts 2 accurately and fully.

When ejecting the card 6, a rearward push force is exerted to the card 6 to make the pin member 58 move along the heart-shaped slot 52 again so as to release the slider 51 from the write enable position. At this time, the resilient restorable force of the spring 54 urges the slider 51 to move along the card ejection direction so as to eject the card 6 out of the card connector in virtue of the ejecting member 53 of ejector 5. In the meantime, the contact portions 331 of the scraping/contacting portions 33 of the two pieces of the switch 3 scrape and come in contact with the horizontal plate 561 of the metal portion 56, then the bottom face 512 of the slider 51.

Figure 7:
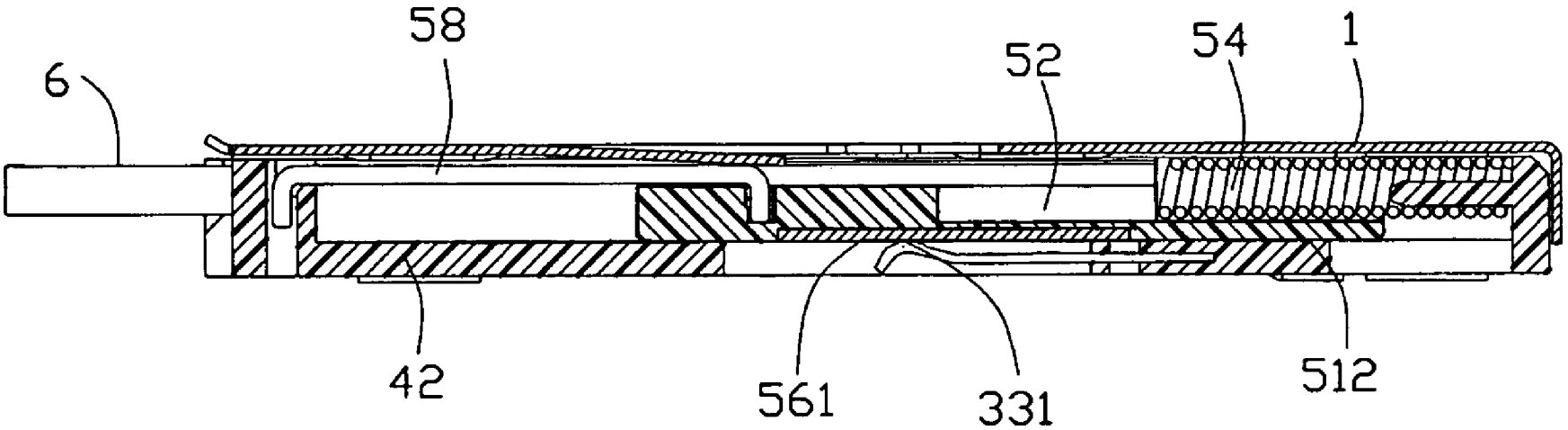
FIG. 7 is a cross-sectional view of FIG. 1 taken along line 6-6 with the card at the write enable position.

As shown in FIG. 7, when the SIM card 6 is at a write enable position, the both of the scraping/contacting portions 33 of the two pieces of the switch 3 come in contact with the horizontal plate 561 of the metal portion 56, turn on the switch.

As shown in FIG. 6, when the SIM card 6 is at the write inhibit position, the both of the scraping/contacting portions 33 of the two pieces of the switch 3 come in contact with the bottom face 512 of the slider 51, at this time, the scraping/contacting portions 33 of the two pieces is parted from the horizontal plate 561 of the metal portion 56, turn off the switch.

In this switch structure because the scraping/contacting portions 33 of the two pieces of the switch 3 come into or out of contact with the horizontal plate 561 of the metal portion 56 according to the position of the horizontal plate 561 of the metal portion 56 fixed to the slider 51, it is possible to determine at which position, the write enable position or the write inhibit position, the horizontal plate 561 of the metal portion 56 is situated by detecting the connection or disconnection of these pieces of switch 3.

The thin metal ejecting member 53 can endure the force as a more thick normal ejecting member made of insulating materials endures during the card 6 inserts or is ejected, to some degree, the thin metal ejecting member is better to minimize the card connector. On the other hand, the ejecting member 53 is fixed to the slider 51 by the holding arm 563 of the metal portion 56. The joint is more powerful of the ejecting member 53 and the slider 51, than a joint of a ejecting member and a slider of normal integral insulating slider.

As a change embodiment, the pieces may be retained in the insulating housing in two row vertical the card insertion/ejection direction. As a result, one of said pieces of switch comes into contact with the conductive plate always, during the slider sliding between the write enable position and the write inhibit position. While the other one of said pieces of switch comes into contact with the slider or the conductive plate orderly, comes into contact with the conductive plate firstly, then the slider during the slider sliding from the write enable position to the write inhibit position, comes into contact with the slider firstly, then the conductive plate during the slider sliding from the write inhibit position to the write enable position. In addition, the pieces may be retained in the insulating housing to engage with the slider on two or more surfaces, the metal portion comprises several corresponding plates to cover with at least one sidewall of the slider, and the several plates of the metal portion, formed with a plurality of hooks protruding from lateral sides thereof interferentially received in corresponding slots of the slider, are fixed to the slider.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector adapted for receiving a card, comprising:

an insulating housing defining a card receiving space for accommodating said card and a receiving cavity communicating with the card receiving space;

a plurality of contacts retained in the insulating housing;

an ejector assembled to the insulating housing and comprising an insulating slider sliding in the receiving cavity and an ejecting member protruding into the card receiving space; and a switch comprising a pair of conductive pieces and a conductive plate, said conductive plate being fixed to said slider, said conductive pieces retained in said insulating housing and engaging with said slider; wherein both of said pair of conductive pieces came into contact with said conductive plate when the card inserts and urges the slider sliding to a first position, while at least one of the conductive piece comes out of contact with said conductive plate when the ejector ejects the card and urges the slider; sliding to a second position.

2. The card connector as described in claim 1, wherein one of said pieces comes into contact with the slider or the conductive plate orderly, the other one of said pieces comes into contact with the conductive plate always, during the slider sliding between the first position and the second position.

3. The card connector as described in claim 1, wherein said pieces have arcuate contact portions, the arcuate contact portions scrape the slider or the conductive plate.

4. The card connector as described in claim 1, wherein said ejecting member is a metal plate.

5. The card connector as described in claim 1, wherein said receiving cavity has a recess section recessed downwardly from a bottom face thereof, said conductive pieces partly received in the recess section and partly exposed into the receiving cavity.

6. The card connector as described in claim 1, wherein said card receiving space is defined by sidewalls and a bottom wall, said bottom wall is formed a plurality of receiving passages for receiving said plurality of contacts.

7. The card connector as described in claim 1, wherein both said pieces of switch come into contact with the slider synchronously, or come into contact with the conductive plate synchronously, during the slider sliding between the first position and the second position.

8. The card connector as described in claim 7, wherein said pair of conductive pieces is arranged in a row perpendicular to the card insertion/ejection direction.

9. The card connector as described in claim 1, wherein said ejector member is unitary with said conductive plate.

10. The card connector as described in claim 9, wherein said conductive plate extends upward and rearward from rear end thereof to form a holding arm, the holding arm joining the ejecting member to the conductive plate.

11. The card connector as described in claim 1, wherein said conductive plate is disposed on at least one sidewall of the slider.

12. The card connector as described in claim 11, wherein said conductive plate is formed with a plurality of hooks protruding from lateral sides thereof, said slider is formed with a plurality of slots recessed inward from at least one surface thereof, said conductive plate is fixed to said slider with the hooks interferentially received in the slots.

13. The card connector as described in claim 11, wherein said conductive plate is a horizontal metal plate.

14. The card connector as described in claim 13, wherein said conductive plate is formed with a plurality of hooks protruding upwardly from lateral sides thereof, said slider is formed with a plurality of slots recessed upwardly from lateral sides of a bottom face thereof, said conductive plate is fixed to said slider with the hooks interferentially received in the slots.

15. A card connector adapted for receiving a card, comprising:

an insulating housing defining a card receiving space for accommodating a card and a receiving cavity communicating with the card receiving space;

a plurality of contacts retained in the insulating housing; and an ejector sliding along the receiving cavity and comprising an ejecting member protruding into the card receiving space to collide with a card; wherein at least one switch contact is located in a path of the ejector so as to be electrically activated by said ejector rather than by said card; wherein said elector includes a conductive plate to activate said at least one switch contact for electrical transition therebetween.

16. The card connector as described in claim 15, wherein the ejecting member is secured to the ejector by a metal portion, the ejecting member and the metal portion are unitarily from metal.

17. A card connector adapted for receiving a card, comprising:

an insulating housing defining a card receiving space for accommodating a card and a receiving cavity communicating with the card receiving space;

a plurality of contacts retained in the insulating housing; and an ejector sliding along the receiving cavity and comprising an ejecting member protruding into the card receiving space to collide with a card; wherein at least a portion of said ejector is made of metal, and said portion electrically activates at least a switch contact.

18. The card connector as recited in claim 15, wherein the card does not pass the path.

19. The card connector as described in claim claim 17, wherein said ejecting member and said portion are unitarily formed by metal.

* * * * *